US011066233B2

(12) United States Patent
Jian

(10) Patent No.: US 11,066,233 B2
(45) Date of Patent: Jul. 20, 2021

(54) FOLDABLE CONTAINER

(71) Applicant: SHANGHAI HONGYAN RETURNABLE TRANSIT PACKAGINGS CO., LTD, Shanghai (CN)

(72) Inventor: Yuanli Jian, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 480 days.

(21) Appl. No.: 15/572,366

(22) PCT Filed: May 5, 2016

(86) PCT No.: PCT/CN2016/081179
§ 371 (c)(1),
(2) Date: Feb. 12, 2018

(87) PCT Pub. No.: WO2016/177338
PCT Pub. Date: Nov. 10, 2016

(65) Prior Publication Data

US 2018/0265282 A1 Sep. 20, 2018

(30) Foreign Application Priority Data

May 7, 2015 (CN) ..... 201510229497.9

(51) Int. Cl.
*B65D 88/52* (2006.01)
*B65D 19/18* (2006.01)
*B65D 19/06* (2006.01)

(52) U.S. Cl.
CPC ..... *B65D 88/522* (2013.01); *B65D 19/06* (2013.01); *B65D 19/18* (2013.01); *B65D 88/52* (2013.01);
(Continued)

(58) Field of Classification Search
CPC ..... B65D 88/522; B65D 88/52; B65D 19/06; B65D 19/12; B65D 19/16; B65D 2519/00646; B65D 2519/009
See application file for complete search history.

(56) References Cited

U.S. PATENT DOCUMENTS 3,982,650 A * 9/1976 Ichihara ..... B65D 11/1833 220/4.28
5,938,059 A * 8/1999 Luburic ..... B65D 11/1833 220/4.32
2014/0231425 A1* 8/2014 Jian ..... B65D 19/06 220/7

FOREIGN PATENT DOCUMENTS

CN 1402682 A 3/2003
CN 102574607 A 7/2012
(Continued)

OTHER PUBLICATIONS

International Search Report (Chinese and English) and Written Opinion of PCT/CN2016/081179 dated Jul. 6, 2016, 8 pages provided.

*Primary Examiner* — Don M Anderson
(74) *Attorney, Agent, or Firm* — Hamre, Schumann, Mueller & Larson, P.C.

(57) ABSTRACT

A foldable container, comprising a base and two pairs of side plates, and the side plates are connected to the base via a hinge structure. A plurality of protruding portions are disposed below the side plates, and a polarity of grooves matching the protruding portions are disposed on the base. The hinge structure is disposed in at least one of the protruding portions and at least one of grooves. At least one of the protruding portions is further provided with a continuous curved surface profile, and at least one of the grooves is further provided with at least one matching surface, or at least one of the grooves is provided with a
(Continued)

continuous curved surface profile, and at least one of the protruding portions is provided with a matching surface. The matching surface matches the continuous curved surface profile, and when the side plate changes from a folded state to the open state, the continuous curved surface profile remain contacting with the matching surface. The foldable container can address the problems of interference and collision in a process of unordered rotation of hinged side plates.

9 Claims, 24 Drawing Sheets

(52) U.S. Cl.
CPC ..... *B65D 2519/009* (2013.01); *B65D 2519/00338* (2013.01); *B65D 2519/00587* (2013.01); *B65D 2519/00636* (2013.01); *B65D 2519/00646* (2013.01); *B65D 2519/00711* (2013.01); *B65D 2519/00975* (2013.01)

(56) References Cited

FOREIGN PATENT DOCUMENTS

| | | | |
|---|---|---|---|
| CN | 104554980 | A | 4/2015 |
| CN | 104944012 | A | 9/2015 |

* cited by examiner

FOLDABLE CONTAINER

FIELD

The invention relates to a container, in particular a foldable container.

BACKGROUND

It is well-known that large-type foldable containers are mostly composed of a base and two pairs of side plates. One of two pairs of side plates is longer and the other pair is shorter. An optional certain side plate is provided with a small door, and the entire box can also be equipped with a lid. In most cases, the side plates of large-type foldable container are connected with base via a hinge structure. The hinge structure is commonly designed in a disorderly folded manner. That is, the opposite two side plates have identical structures (or have other same structures even with the one provided with small door), no matter which one of the opposite side plates is firstly folded, the folding action can be completed, so that the user won't worry about the folding times, thus improving the operation efficiency and meanwhile such a design can reduce the production cost and eliminate the inconvenience of production and management caused by the difference between the opposite side plates of conventional foldable containers using ordered hinge. However, based on the feedback of users and the result of our extensive experimental operation, the aforementioned disordered hinge suffers from the drawback that after the opposite side plates with disordered hinge are folded, the later folded side plate lies flat on the preciously folded one and the hinge structure is lifted to a distance, and when the side plates need to be erected, the hinge structure of the overlying side plate needs to be lowered to the starting portion on the base during its rotation process from the flat on to the upright. If the hinge structure fails to be lowered fully as the overlying side plate is turned to upright or nearly vertical, some structures of the side plates (e.g., buckles of the side plates with respect to the base) would interfere with the base, and the hinge structures of the side plates or the part of the base may be damaged.

According to the analysis, it takes time for the hinge of side plate to fall, and interference problems occur, if the side plate turns in place faster than the hinge of side plate falls. The main reasons for the problem are the user's operation habits to open side plates, the position of the center of gravity of the side plate and the mating tolerance between hinge of the side plate and the base, and in actual use, the overlying side plate of the later folded pair of side plates (ordinarily means the longer pair) prone to arise the problem of falling delay of hinge.

In order to adapt to different operation habits and reduce the damage of parts caused by the falling delay of hinge of side plate, we need to find new structure to solve the problem.

SUMMARY

It is an object of the present invention to provide an overturned reset structure for a disorderly hinge of the side plates of a foldable container to solve the problems existing in the above conventional foldable container.

In order to achieve the above object, according to one aspect of the present invention, a foldable container is provided. The foldable container comprises a base and two pairs of side plates connected to the base via a hinge structure, wherein a plurality of protruding portions are provided on the side plates, and a plurality of grooves are provided on the base to match the protruding portions, and the hinge structure is provided in at least one of the protruding portions and at least one of the grooves, wherein the at least one of the protruding portions is further provided with a continuous curved surface profile, and the at least one of the grooves is further provided with at least one matching surface to match the continuous curved surface profile, or the at least one of the grooves is provided with a continuous curved surface profile, and the at least one of the protruding portions is provided with a matching surface to match the continuous curved surface profile, and during the process that the side plate are changed from a folded state to an open state, the continuous curved surface profile always contacts with the matching surface.

Preferably, the side plates and the base of the foldable container are folded in disorderly folding manner.

Preferably, during the process that the side plates are changed from a folded state to an open state, the continuous curved profile remains tangent with the matching surface.

Preferably, when the side plate are changed from a folded state to an open state, a tangent point formed by the continuous curved profile and the matching surface continuously moves on the matching surface.

Preferably, at least one side of the protruding portions provided with the continuous curved profile is provided with a protruding block, and the continuous curved profile is the first side surface provided on the protruding block, and a corresponding side of the grooves provided with the matching surface is provided with a side groove, and a stopper is provided above the side groove, and the matching surface is a second side surface provided on the lower side of the stopper.

Preferably, the continuous curved profile further comprises a third side surface, which is configured to contact and match the lower side of the stopper when the side plate is upright with respect to the base.

Preferably, the continuous curved profile further comprises a third side surface, and there is a predetermined gap between the third side surface and a lower side surface of the side plates.

Preferably, the first side surface and the second side surface are configured when the side plate changes from the folded state to the open state, the first side surface inscribe and contacts with the second surface and the base generates a result force on the side plates, and the result force can be decomposed into a vertical component force causing the protruding portions to move downward and a horizontal component force parallel to the base.

Preferably, an angle between the result force and the horizontal force is less than or equals to 45 degree.

Preferably, at least one side of the protruding portions is provided with a guide pin, and the matching surface is the forth side surface provided on the guide pin, and a corresponding side of the groove is provided with a side groove, and a stopper is provided above the groove, and the continuous curved profile is a fifth side surface provided on the lower side of the stopper.

Preferably, the guide pin is a cylindrical pin, and the matching surface is an external surface of the cylindrical pin.

Preferably, the hinge structure comprises a hinge pin provided on the protruding portion and a matching structure provided in the groove.

Preferably, one side of the protruding portion is provided with the hinge pin, and the other side of the protruding portion is provided with the continuous curved profile, and the matching structure is the straight groove provided on one side of the groove.

Preferably, the continuous curved surfaces are provided on both sides of the protruding portions, and the hinge pin is provided on the front end of the protruding portion, and the matching structure matches the hinge pin so that the hinge pin can move up and down along the matching structure.

Preferably, the matching structure is the guide column provided in the groove, and the guide column matches the hinge pin so that the hinge pin can move up and down along the guide column.

Preferably, a through hole is provided in the middle portion of the hinge pin, and the guide column passes through the through hole so that the guide column can slide up and down within the through hole.

The invention discloses an overturn reset structure of a disordered hinge for large-sized foldable container, which ingeniously utilizes a type of cam mechanism of contact, rotation and displacement, and addresses the problems of the interference and collision in a process of rotation of the unordered hinge of the side plates.

DETAILED DESCRIPTION OF EMBODIMENTS

Figure 1:
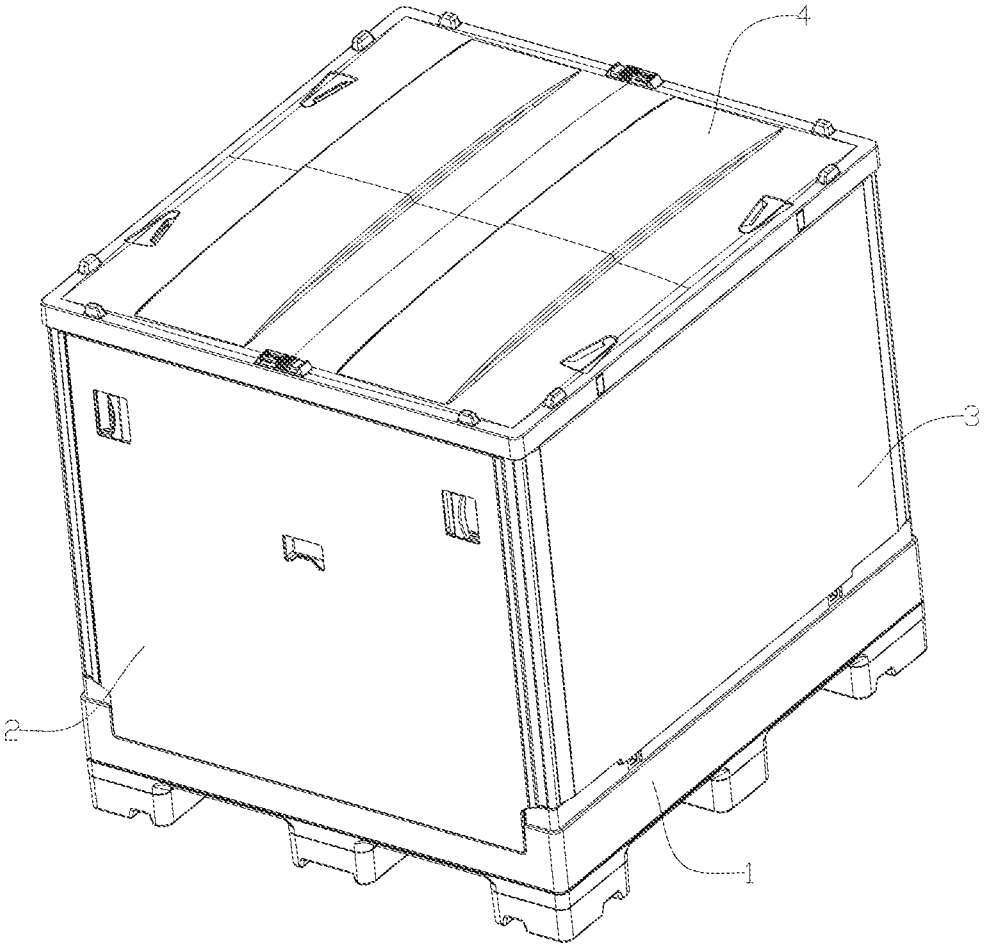
FIG. 1 is a perspective view of a foldable container of the present invention.

The preferred embodiments of the present invention will be described in detail below with reference to the accompanying drawings in order to understand the purpose, features and advantages of the present invention more clearly. It should be understood that the embodiments shown in the drawings are not intended to limit the scope of the present invention, but merely illustrate the spirit of the solution of the present invention.

Technical Term Description

Continuous curved profile refers to the external shape of a certain part or structure, including but not limited the first side surface of the protruding block according to the first embodiment and the outer surface of the guide pin according to the second embodiment.

Matching surface refers to a flat surface or a curved surface which cooperates with the continuous curved profile to effectively solve the interference problem incurred by the disordered hinge during the overturning of the side plate, including but not limited to the guide surface according to the first embodiment and the third embodiment.

Disorderly folding means the two opposite side plates are of the same structure (or have other same structure even if with the one provided with a small door), and the folding action can be completed by firstly folding any one of the opposite side plates.

Protruding portion refers to a portion protruded from the side plate, including but not limited to the hinge protruding portion and the guide portion according to the embodiments of the present invention.

Groove including but not limited to the hinge groove and the guide groove according to the embodiments of the present invention.

FIG. 1 shows a perspective view of a foldable container of the present invention. As shown in FIG. 1, the foldable container 100 comprises a base 1, two pairs of side plates 2, 3 and a lid 4. However, those skilled in the art may understand the foldable container 100 may not include the lid 4, and a small door may also be selectively provided on the side plates 2, 3.

Figure 2:
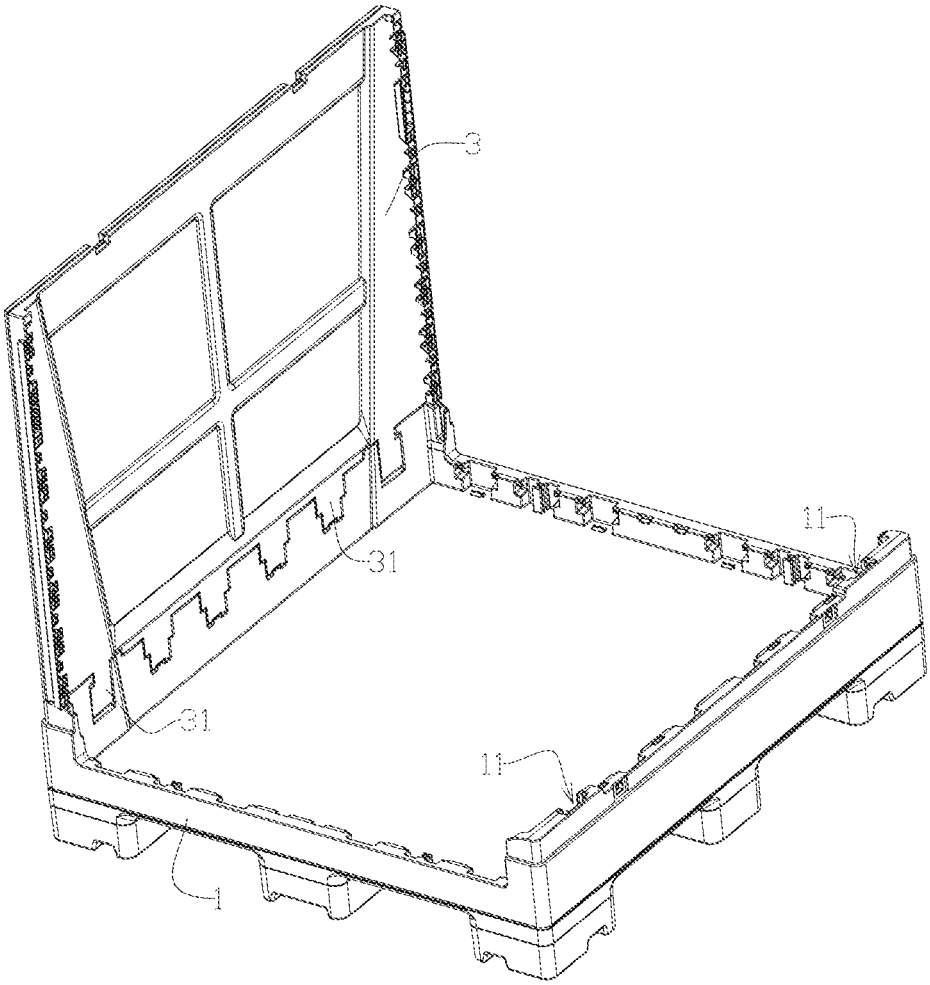
FIG. 2 is a perspective view of part of the foldable container when the side plate is in an open state according to the first embodiment of the present invention.
Figure 3:
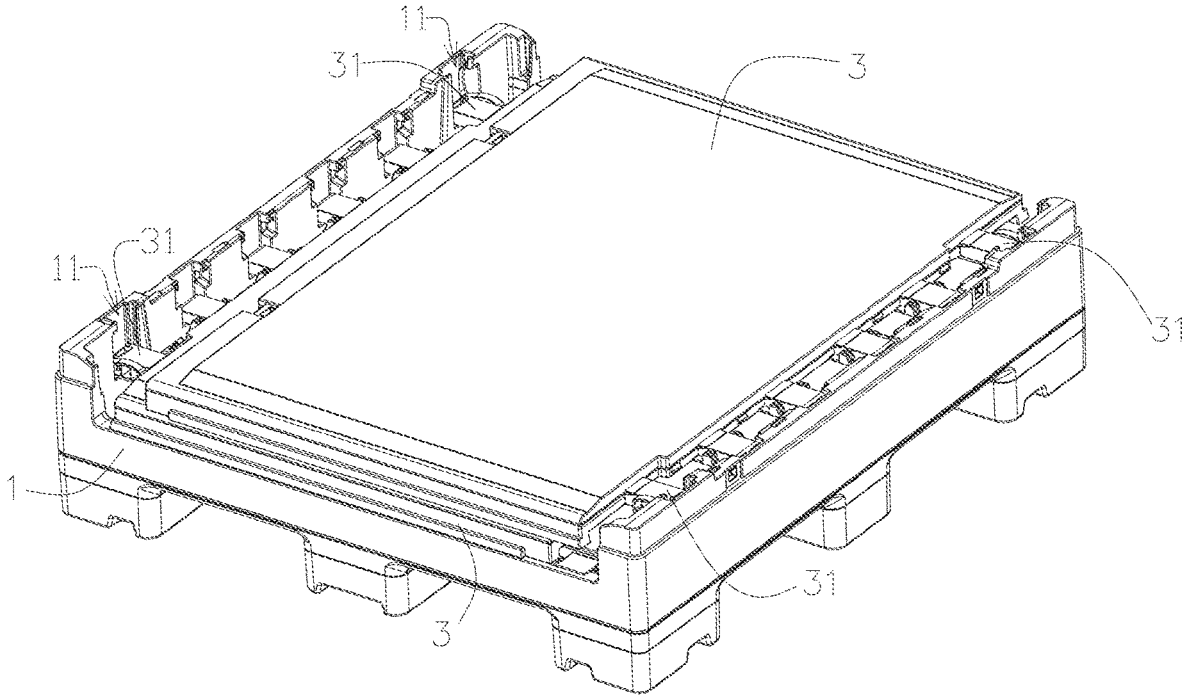
FIG. 3 is a perspective view of the foldable container when the side plate is in a folded state according to the first embodiment of the present invention.

FIGS. 2-3 show partial perspective views of the foldable container of the present invention, wherein the side pate 3 in FIG. 2 is in an upright state, and the side plate 3 in FIG. 3 is in a folded state. As shown in FIGS. 2-3, taking side plate 3 as an example, a polarity of hinge protruding portions 31 are protruded from the side plate 3 to cooperate with the hinge groove 11 on the base 1, so that the side plate 3 is rotatable relative to the base 1 between the upright state and folded state, and no matter which one of the opposite side plates 3 rare folded first, the two opposite side plates 3 can be flatly folded in place, that is, the later folded side plate 3 is tightly pressed against the previously folded plate 3, and at this time, the hinge protruding portion 31 in the hinge groove 11 is raised by a certain distance with respect to the position in the upright state.

The overturned reset structure for a disorderly hinge of the present invention would be illustrated below by describing a hinge protruding portion 31 on the side plate and its cooperating hinge groove 11 on the base.

The First Embodiment

The first embodiment of the present invention will be described below with reference to FIGS. 4-11.

Figure 4:
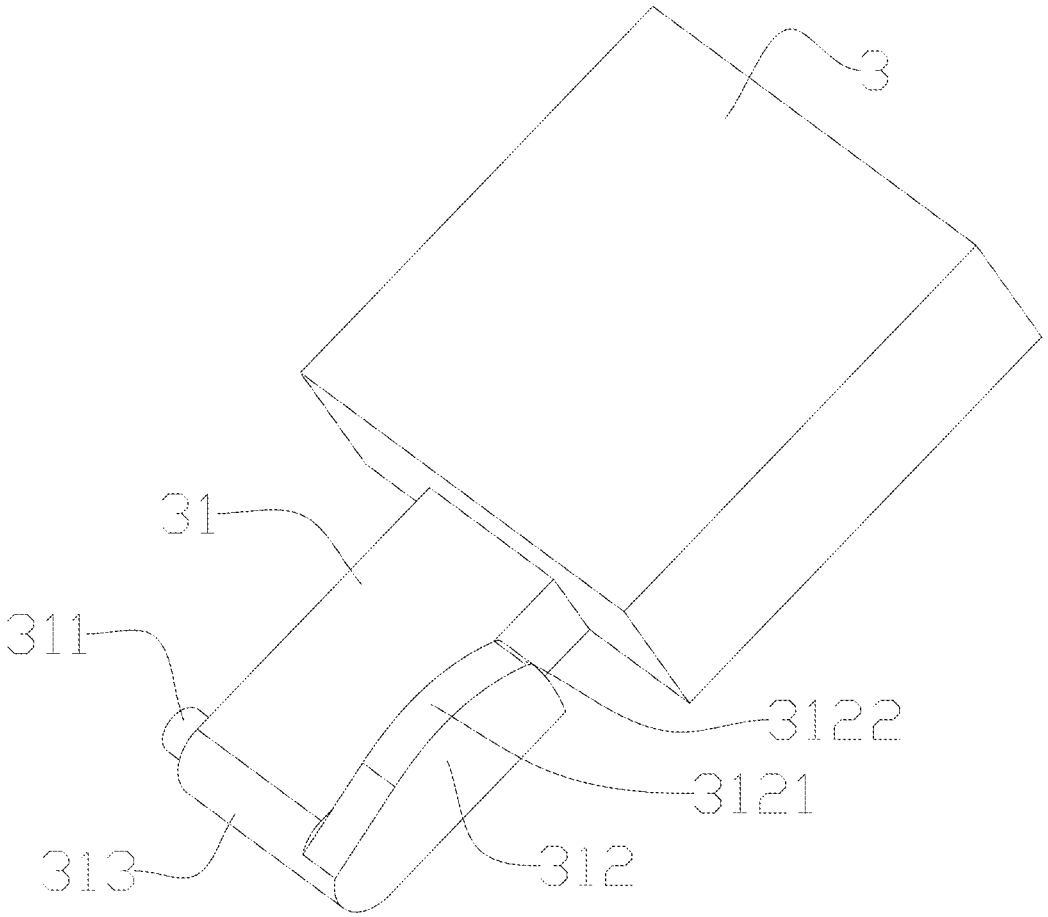
FIG. 4 shows a perspective view of a hinge protruding portion according to the first embodiment of the present invention.

FIG. 4 is a perspective view of a hinge protruding portion 31. As shown in FIG. 4, the hinge protruding portion 31 has a rectangular parallelepiped shape as a whole, and a hinge pin 311 is provided on one side thereof (in the direction of the figure), and a protruding block 312 is provided on the other side thereof. The hinge pin 311 and the protruding block 312 are respectively located on both sides. The protruding block 312 is provided with a first side surface 3121 and a hanging step 3122. The protruding block 312 cooperates with the side groove of the hinge groove on the base 1, which will be described in detail below. Preferably, the front end of the hinge protruding portion 31 is further provided with a third side surface 313.

Figure 5:
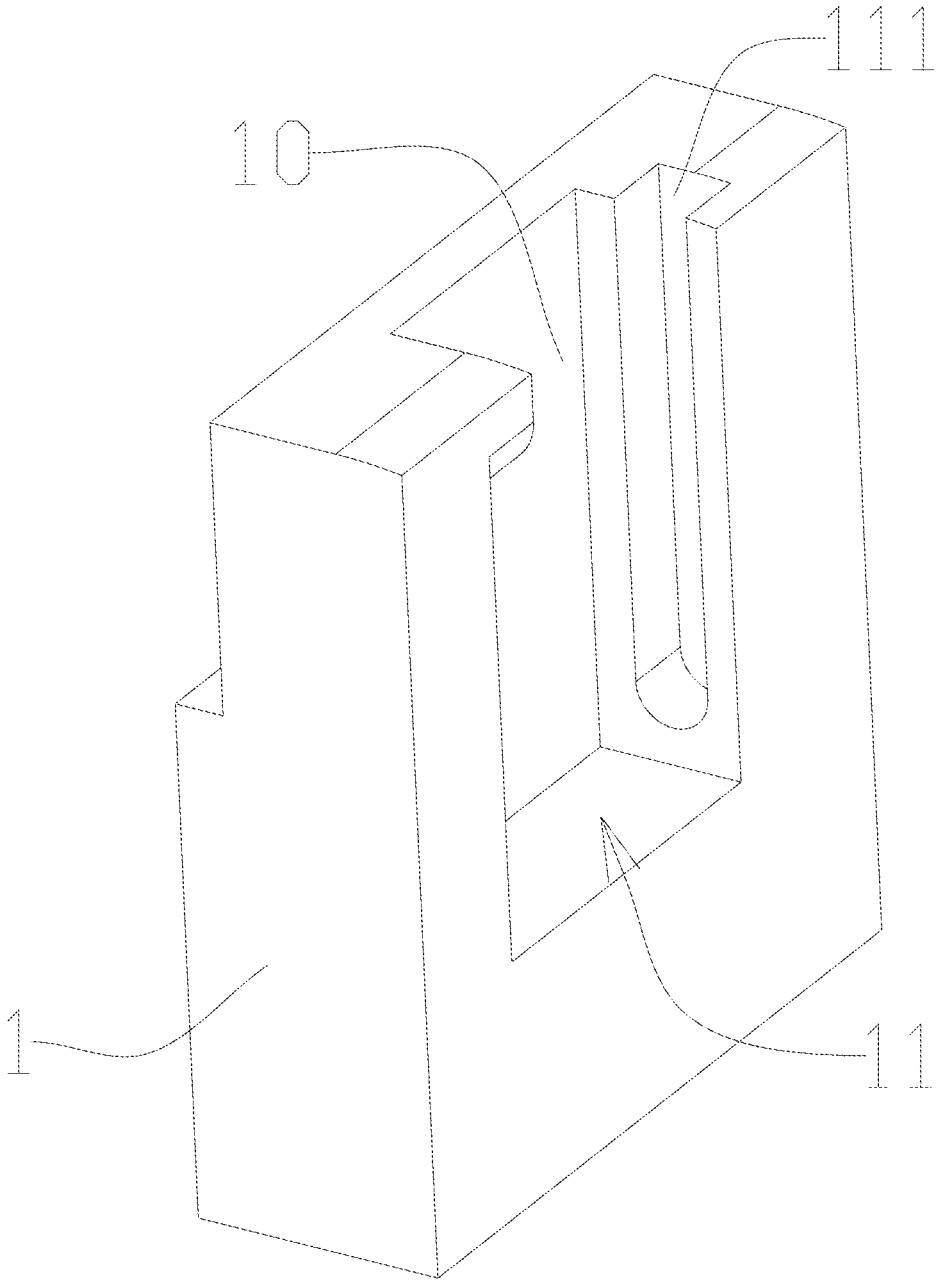
FIG. 5 shows a perspective view of a hinge groove according to the first embodiment of the present invention.
Figure 6:
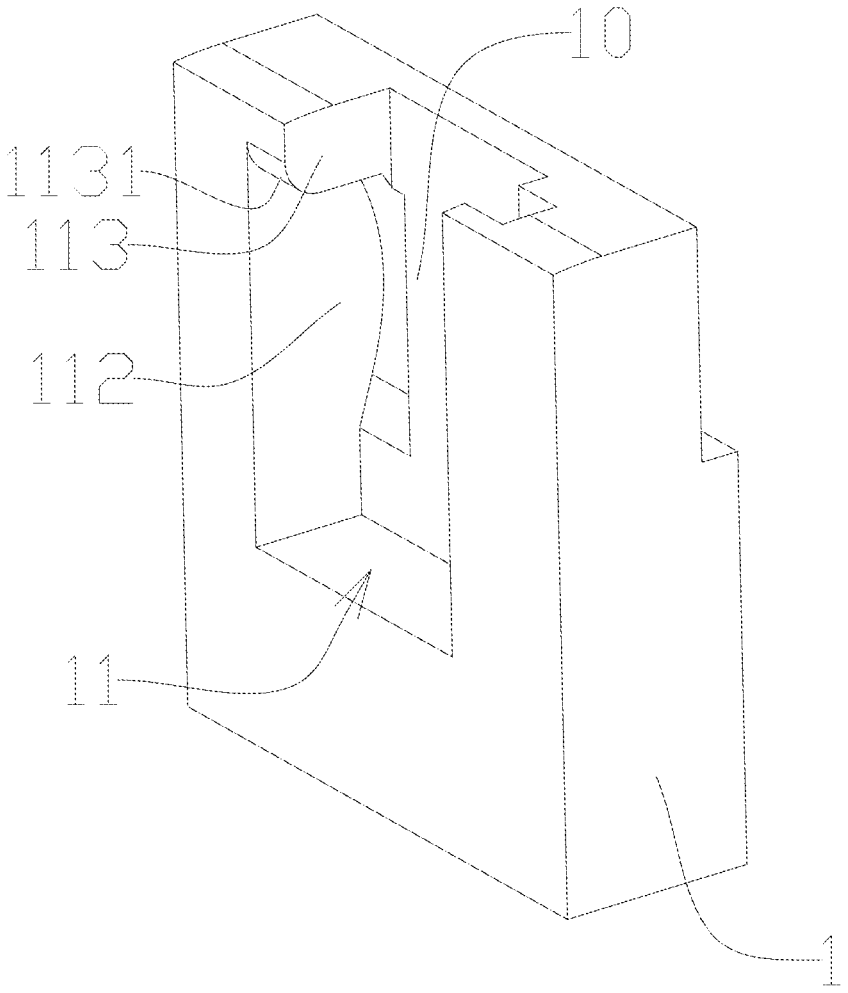
FIG. 6 shows another perspective view of the hinge groove according to the first embodiment of the present invention.

FIGS. 5-6 show a perspective structural view of a hinge groove 11 on the base 1. As shown in FIGS. 5-6, the hinge groove 11 comprises a main groove 110, a straight groove 111 provided on one side of the main groove 110, a side groove provided on the other side of the main groove 110. The main groove 110 is used for accommodating the hinge protruding potion 31. The straight groove 111 is used for accommodating the hinge pin 311. The hinge pin 311 can be rotated and slid upwards and downwards in the straight groove 111. The side groove 112 cooperates with the protruding block 312, and a stopper 113 is provided above the side groove 112. When the protruding block 312 is located in the side groove 112, the stopper 113 serves to limit the protruding block 312 and prevent the protruding block 312 from moving upwards. The stopper 113 is further provided with a second side surface 1131. In the present embodiment, the undersurface of the straight groove 111 is arc-shaped so as to facilitate the rotation of the pin 311 in the straight groove 111.

Figure 7:
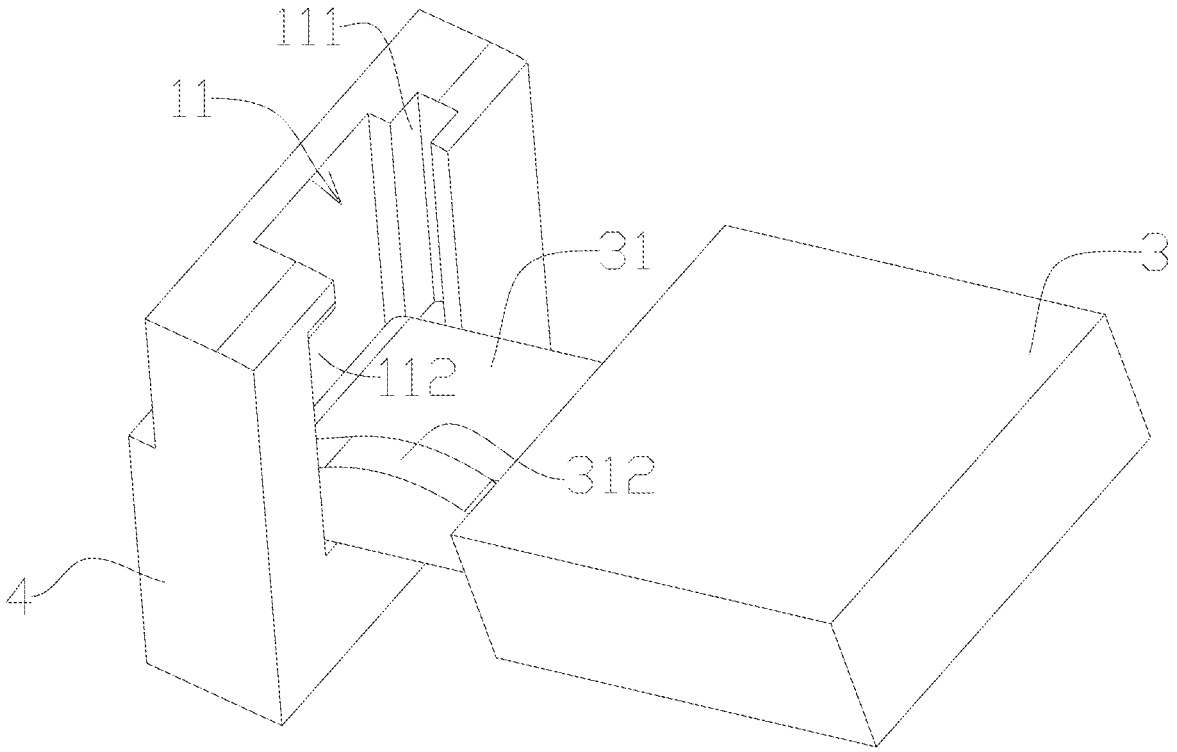
FIG. 7 shows a perspective view of the hinge protruding portion after being fitted to the hinge groove according to the first embodiment of the present invention.
Figure 8:
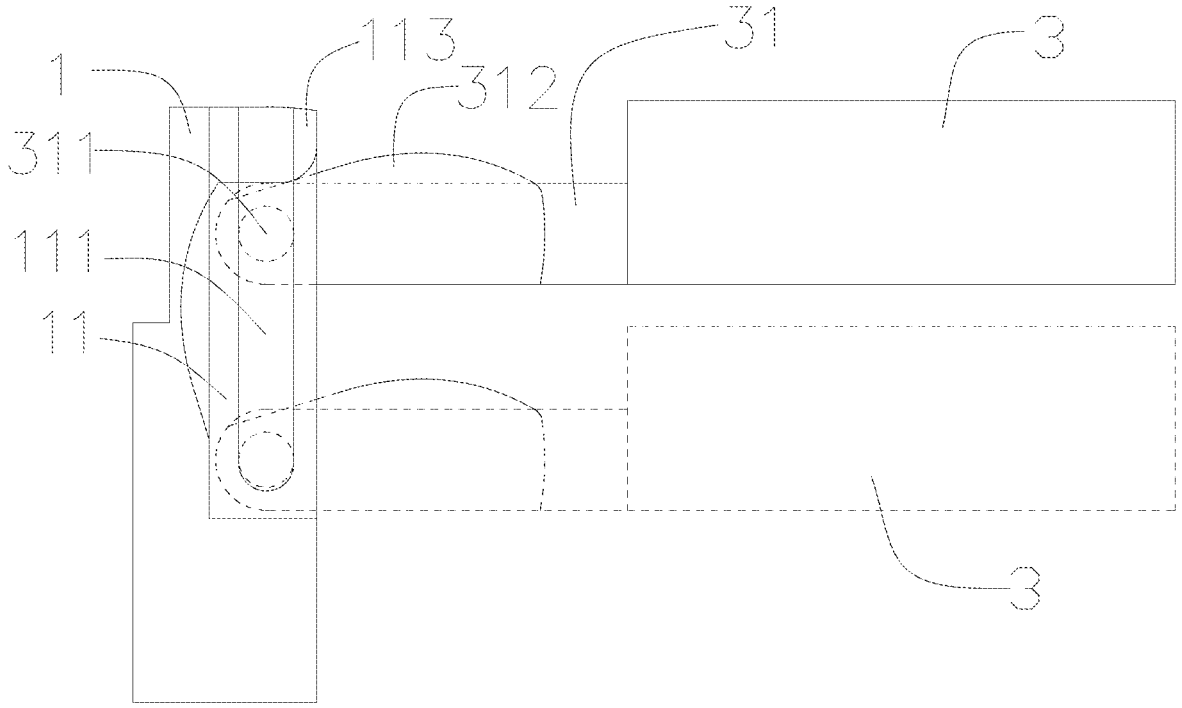
FIG. 8 shows a side view of the hinge protruding portion and the hinge groove when the side plate is in the closed state according the first embodiment of the present invention.
Figure 9:
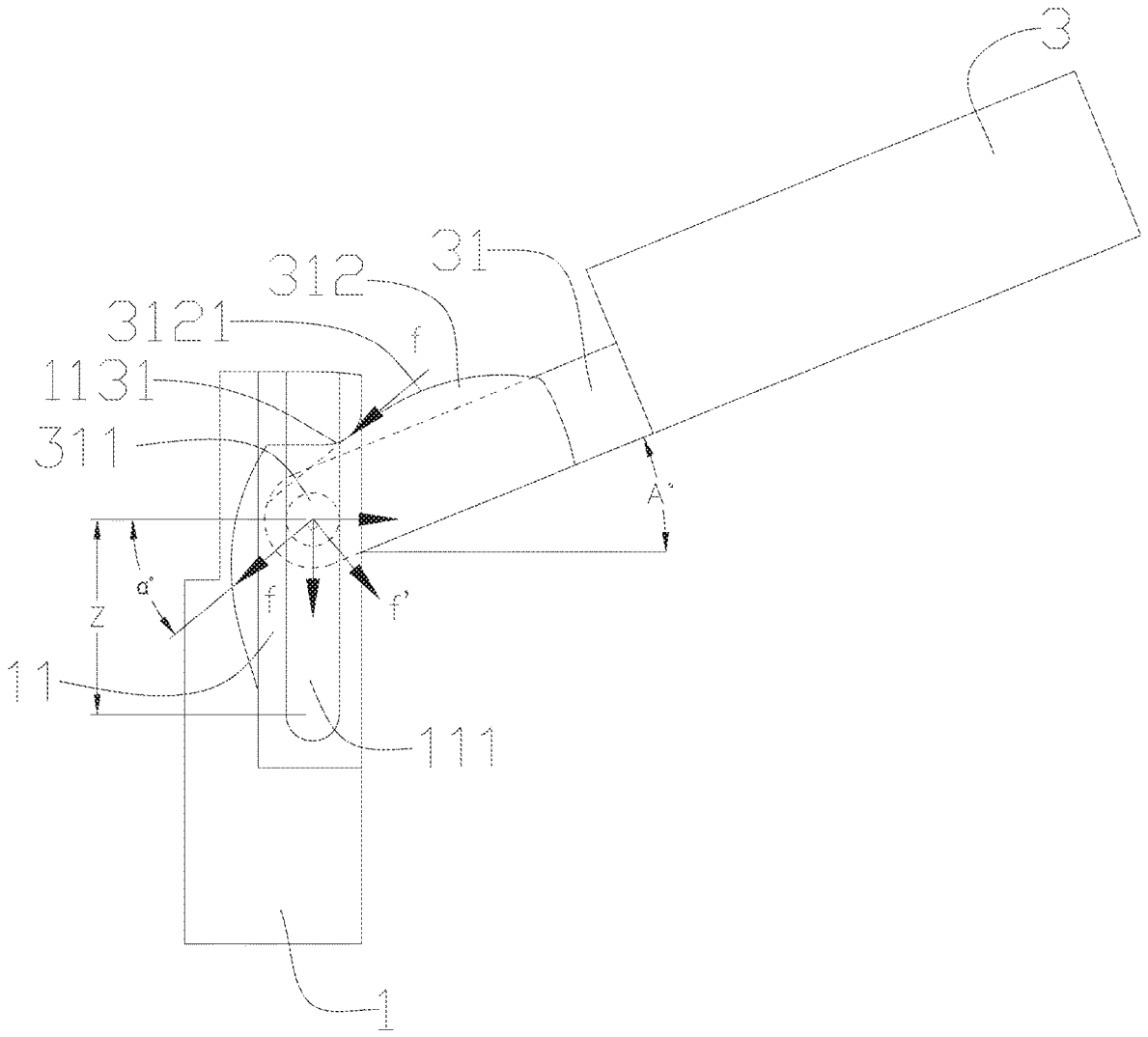
FIG. 9-10 shows a side view of engagement between the hinge protruding portion and the hinge groove according to the first embodiment of the present invention.
Figure 10:
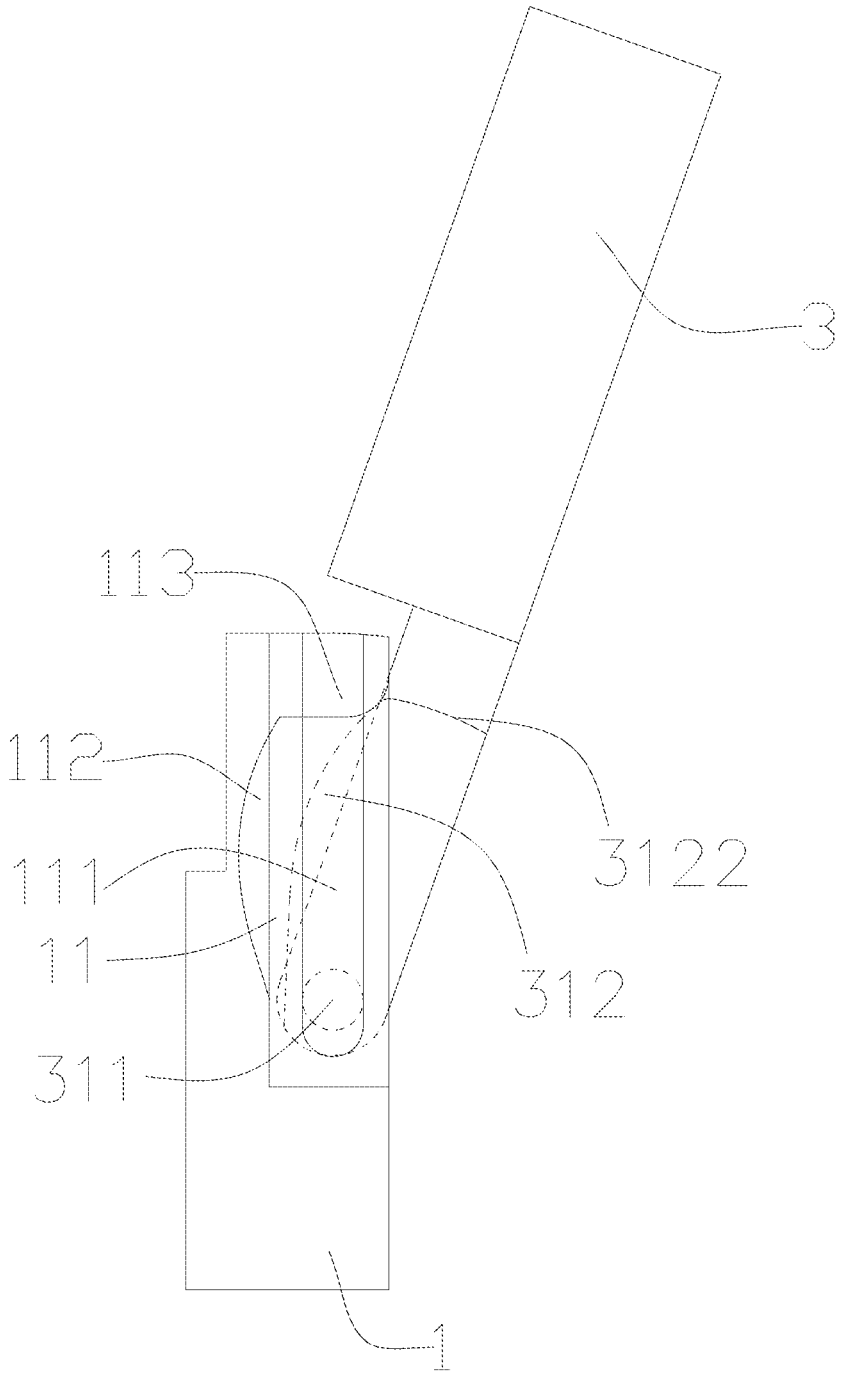

FIG. 7 is a perspective view of the hinge protruding portion 31 of the present invention after being mounted to the hinge groove 11. FIGS. 8-10 are schematic diagrams of the movement of the hinge protruding portion 31 in the hinge groove 11 as the side plate 3 rotate relative to the base 1.

As shown in FIGS. 7-8, after the side plate 3 is mounted to the base 1, the hinge protruding portion 31 is located in the hinge groove 11, wherein the hinge pin 311 is accommodated in the straight groove 111 and is rotatable and slid upwards and downwards in the straight groove 111, so as to ensure that the side plate 3 is capability of limited rotation and movement up and down relative to the base 1. The protruding block 312 cooperates with the side groove 112. When the side plate 3 is in a folded state and the hinge protruding portion 31 is raised by a distance in the hinge groove 11, the stopper 113 will contact the protruding block 312, so as to restrict hinge pin 311 not to disengage from the straight groove, so that during the folded state, the up-to-down floating distance of the side plate 3 relative to the base 1 is within a controllable rang, which is generally no less than the thickness of one side plate 3.

As shown in FIGS. 9-10, during the process of the side plate 3 rotating from the folded state to the open state, the second side surface 1131 will circumscribe the first side surface 3121 of the protruding block 312, causing the base 1 to generate a force f acting on the side plate 3 (the pin 311 of the side plate 3 generate a force f' acting on the base 1). The force f can be decomposed into a vertical component force which causes the hinge protruding portion 31 of the side plate 3 to move downwards and a horizontal component force, so that during the overturing process of the side plate 3, the hinge protruding portion 31 is driven to continuously move downwards by the cooperation of the second side surface 1131 and the first side surface 3121, and reach to the state shown in FIG. 10. When the side plate 3 is fully erected, the protruding block 312 of the hinge protruding portion cooperates with the side groove 113 of the base 1, and the stopper 113 of the base 1 restricts the side plate 3 from moving upwards relative to the base.

In particular, after the protruding block 312 contacts the second side surface 1131, the angle $\alpha$ between force f and the horizontal component force is called as a pressure angle. Obviously, the pressure angle $\alpha$ is allowable to vary, and the smaller the pressure angle $\alpha$ is, the more smooth the process of the hinge protruding portion 31 moving downwards is when the whole side plate is overturned. Those skilled in the art can understand, the maximum allowable pressure angle $\alpha$ is different depending on the actual structure and materials of the parts involved. Therefore, within a specific angle of rotation of the side plate 3 relative to the base 1, the first side surface 3121 of the protruding block 312 cooperating with the second side surface 1131 is a continuous curved surface and the pressure angle $\alpha$ is not greater than the allowable value.

Figure 11:
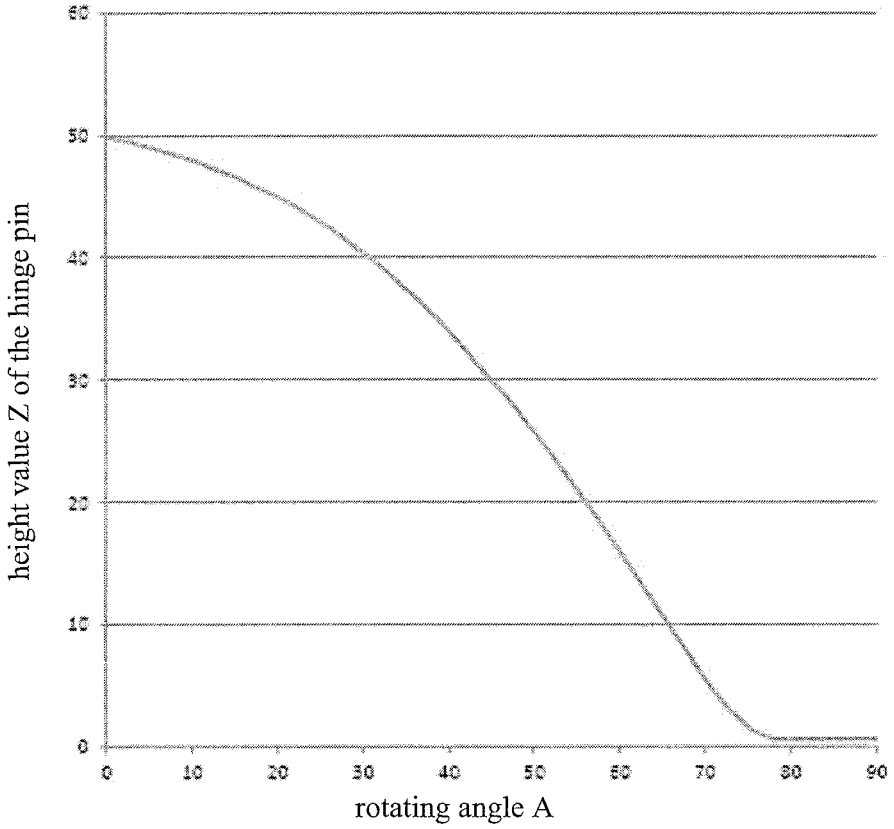
FIG. 11 is a graph showing the relationship between rotating angle A of the side plate and the height Z of the hinge pin.

In the embodiment, as shown in FIG. 9, the maximum value of the pressure angle $\alpha$ generated by the first side surface 3121 of the protruding surface 3121 is 45 degree. And the graph of the relationship between the rotating angle A of the side plate and the height value Z of the hinge pin is shown in FIG. 11.

The Second Embodiment

The present embodiment is basically the same as the first embodiment. The difference is that in the present embodiment the hinge pin 311 of the hinge protruding portion 31 is a separate member, which is detachably attached to the side surface of the hinge protruding portion 31.

Figure 12:
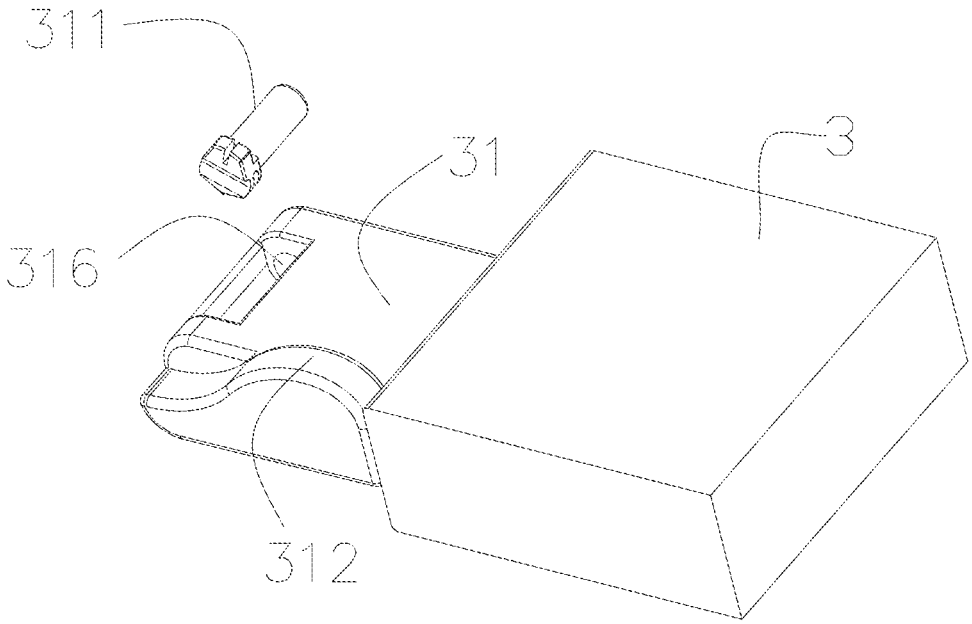
FIG. 12 shows an exploded perspective view of a hinge protruding portion according to a second embodiment of the present invention.

As shown in FIG. 12, a mounting hole 316 is provided on the hinge protruding portion 31. The hinge pin 311 is connected to the hinge protruding portion 31 by inserting and fastening the hinge pin 311 into the mounting hole 316.

The Third Embodiment

The third embodiment of the present invention will be described below with reference to the FIGS. 13-17. Those not described in the third embodiment is similar to that of the first embodiment and the second embodiment, please refer to the related description of the first embodiment and the second embodiment.

Figure 13:
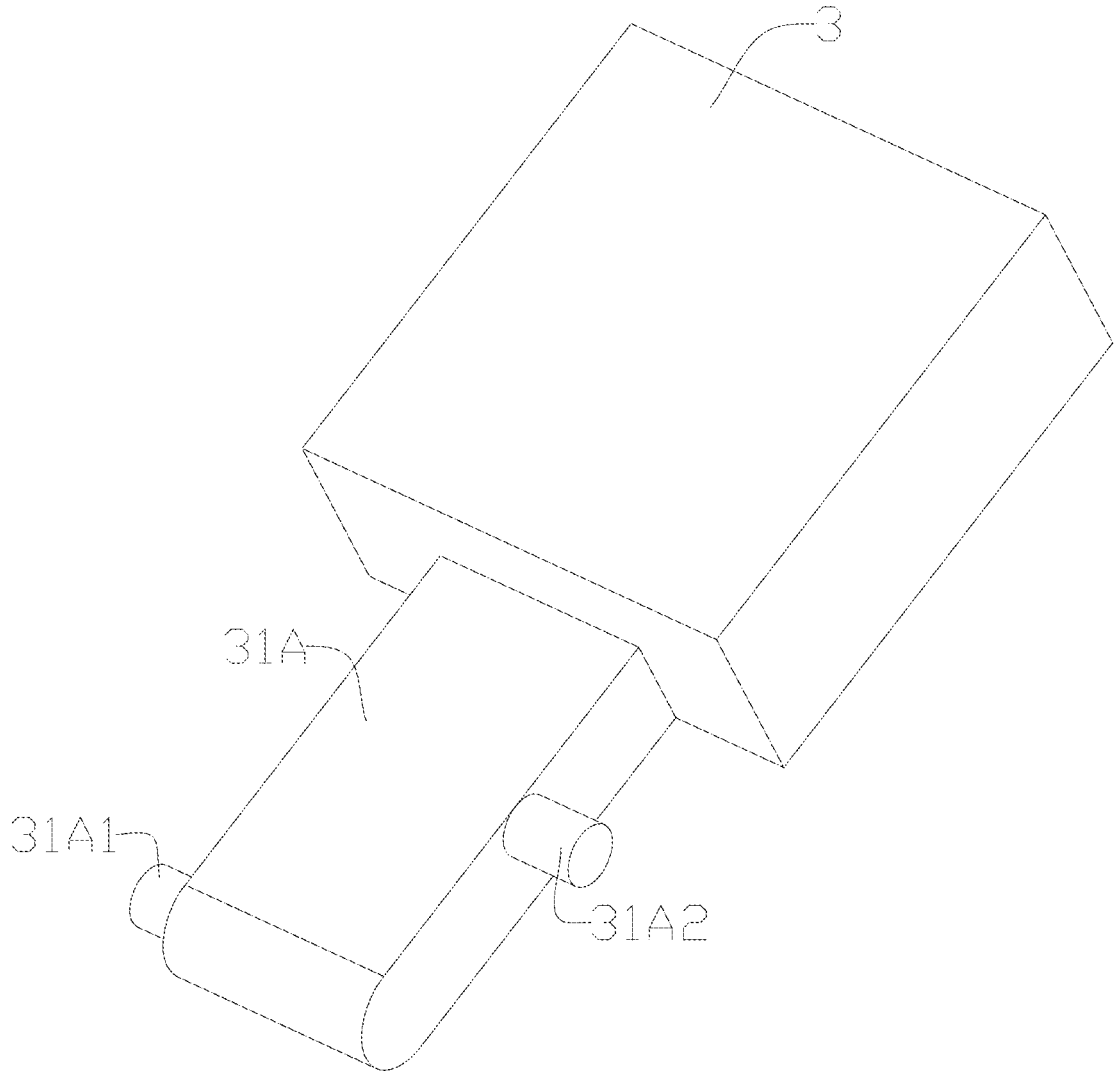
FIG. 13 shows a perspective view of a hinge protruding portion according to a third embodiment of the present invention.

FIG. 13 shows a perspective view of the hinge protruding portion 31A according to the third embodiment of the present invention. As shown in FIG. 13, the hinge protruding portion 31A of the present embodiment has a rectangular parallelepiped shape as a whole, and a hinge pin 31A1 is protruded on one side thereof, and a guide pin 31A2 is protruded on the other side thereof. Wherein the hinge pin 31A1 is used for cooperating with the straight groove 11A1 of the hinge groove 11A, and the guide pin 31A2 is used for cooperating with the fifth side surface 11A2 of the hinge grove 11A. Specifically, the guide pin 31A2 is provided with a fourth side surface (in the present embodiment, the fourth side surface means the outer surface of the guide pin) inscribed on the fifth side surface 11A3. During the process that the side plate 3 is changed from the folded state to the open state, the contact point between the outer surface of the guide pin 31A2 and the fifth side surface 11A3, which is the point of tangency between the outer surface of the guide pin 31A2 and the fifth side surface 11A3 varies constantly. In the present embodiment, the guide pin 31A2 is a cylindrical pin. However, the guide pin 31A2 is not limited to the form of a cylindrical pin, including any forms as long as the guide pin 31A2 is inscribed on the fifth side surface 11A3.

Figure 14:
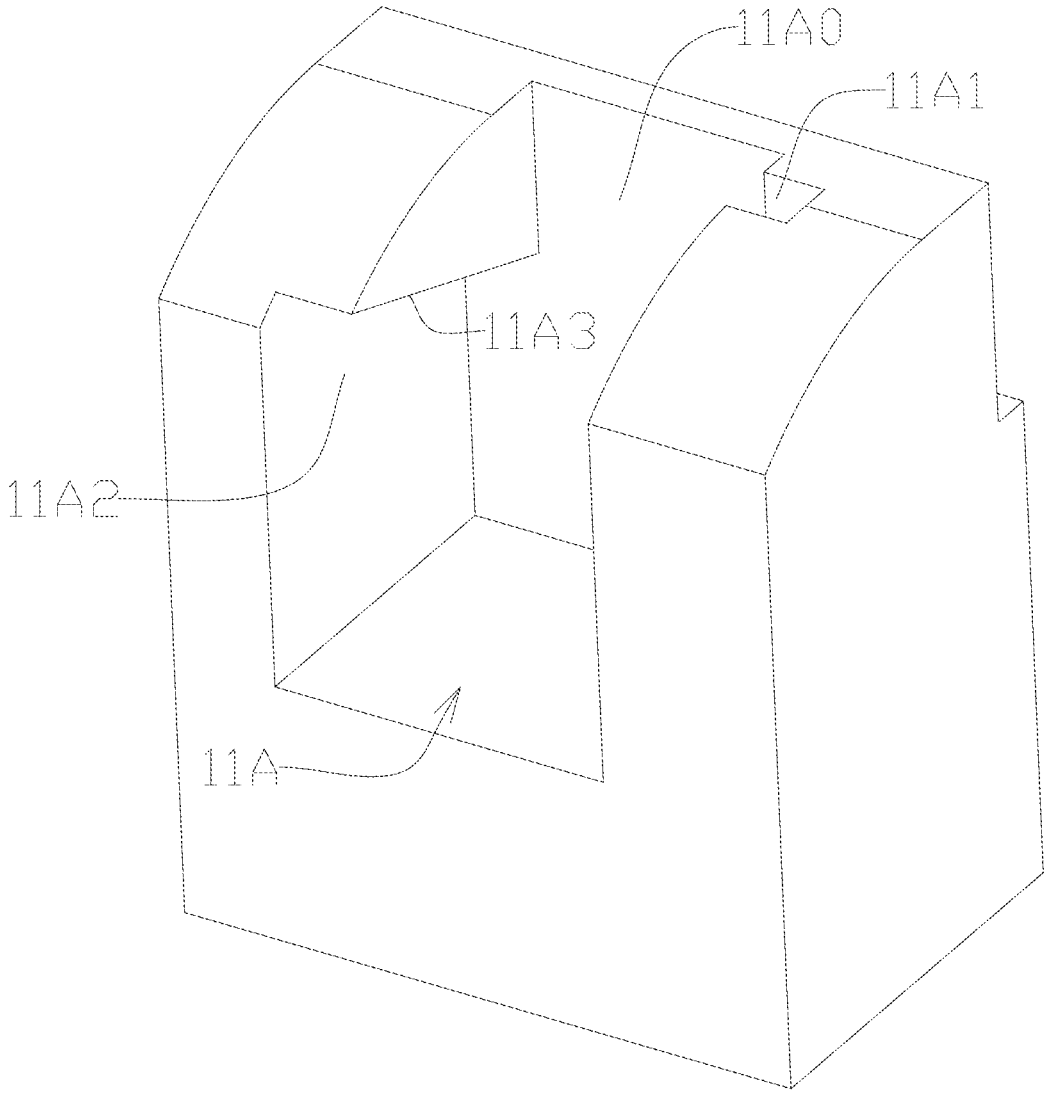
FIG. 14 shows a perspective view of a hinge groove according to the third embodiment of the present invention.

FIG. 14 shows a perspective view of the hinge groove 11A according to the third embodiment of the present invention. As shown in FIG. 14, the hinge groove 11A of the present embodiment is formed on the base 1, comprising a main groove 11A0 and a straight groove 11A1 formed on one side of the main groove 11A0. The hinge protruding portion 31 is mainly accommodated in the main groove 11A0, and the hinge pin 31A1 is fitted in the straight groove 11A1 and can be rotated and slide upwards and downwards within the straight groove 11A1. A straight groove 11A2 is formed on the other side of the main groove 11A0, and a stopper 11A4 is provided above the straight groove 11A2, and a fifth side surface 11A3 is provided below the stopper 11A4. The fifth side surface 11A3 is used for cooperating to the outer surface of the guide pin 31A2.

Figure 15:
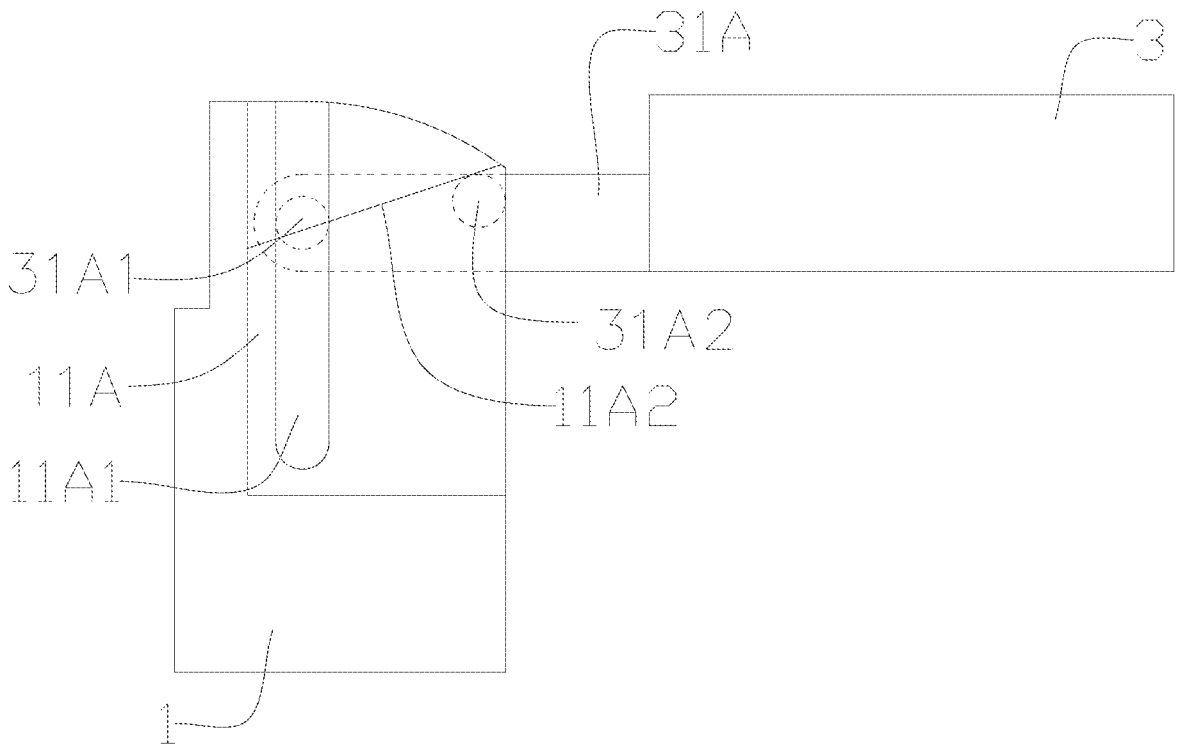
FIG. 15 shows a side matching view between the hinge protruding portion and the hinge groove when the side plate is in the closed state according to the third embodiment of the present invention.

FIG. 15 shows a mating view between the hinge protruding portion 31A and the hinge groove 11A when the side plate 3 is in a closed state according to the third embodiment of the present invention. As shown in FIG. 15, when the side plate 3 is in folded state, the hinge pin 31A1 is located in the straight groove 11A1. The guide pin 31A2 contacts with the fifth side surface 11A3 when the side plate 3 is the folded upper plate. The hinge pin 31A1 is located at the bottom of the straight groove 11A1, when the side plate 3 is the plate located below after being folded.

Figure 16:
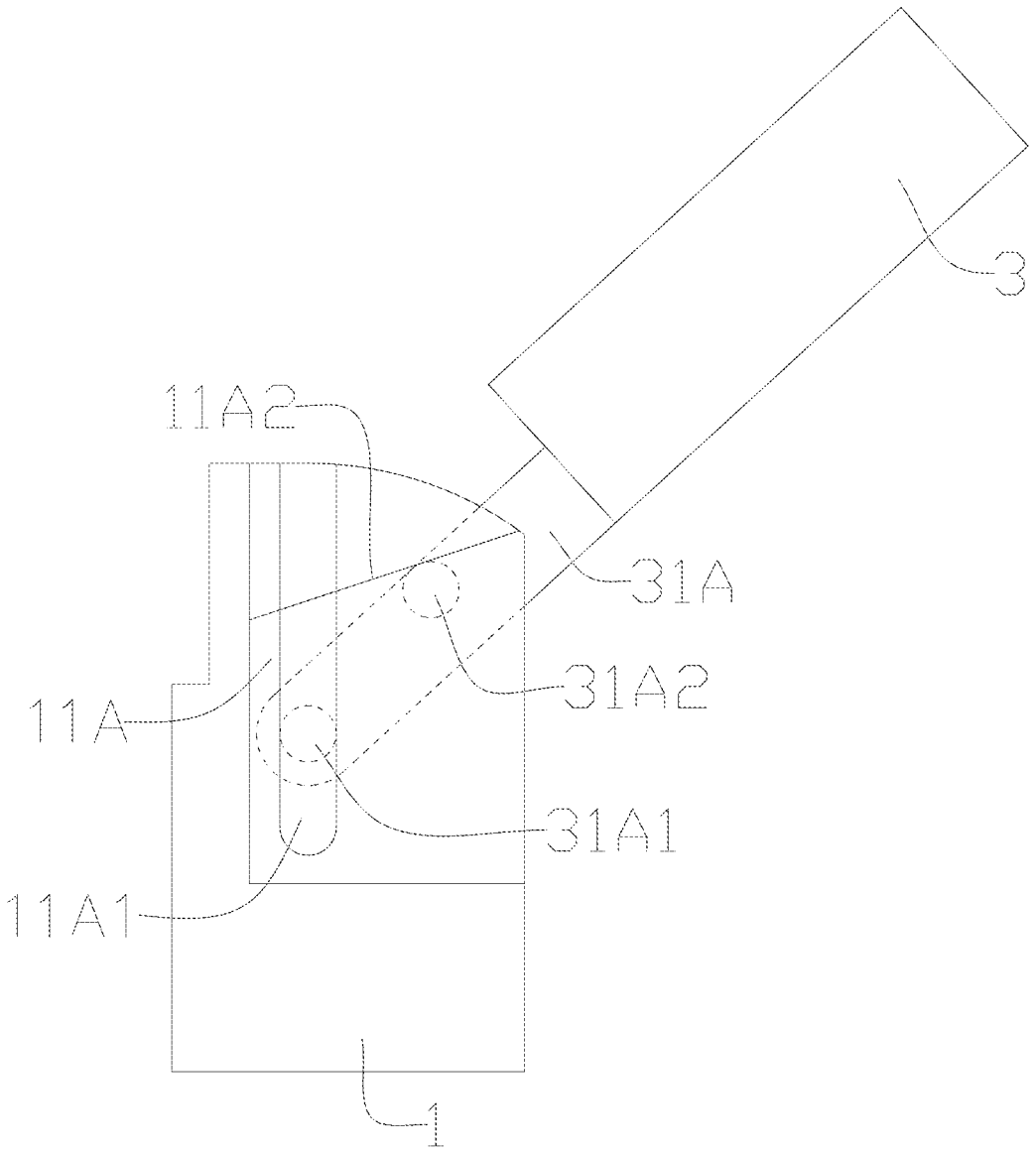
FIGS. 16-17 show side matching views between the hinge protruding portion and the hinge groove according to the third embodiment of the present invention.
Figure 17:
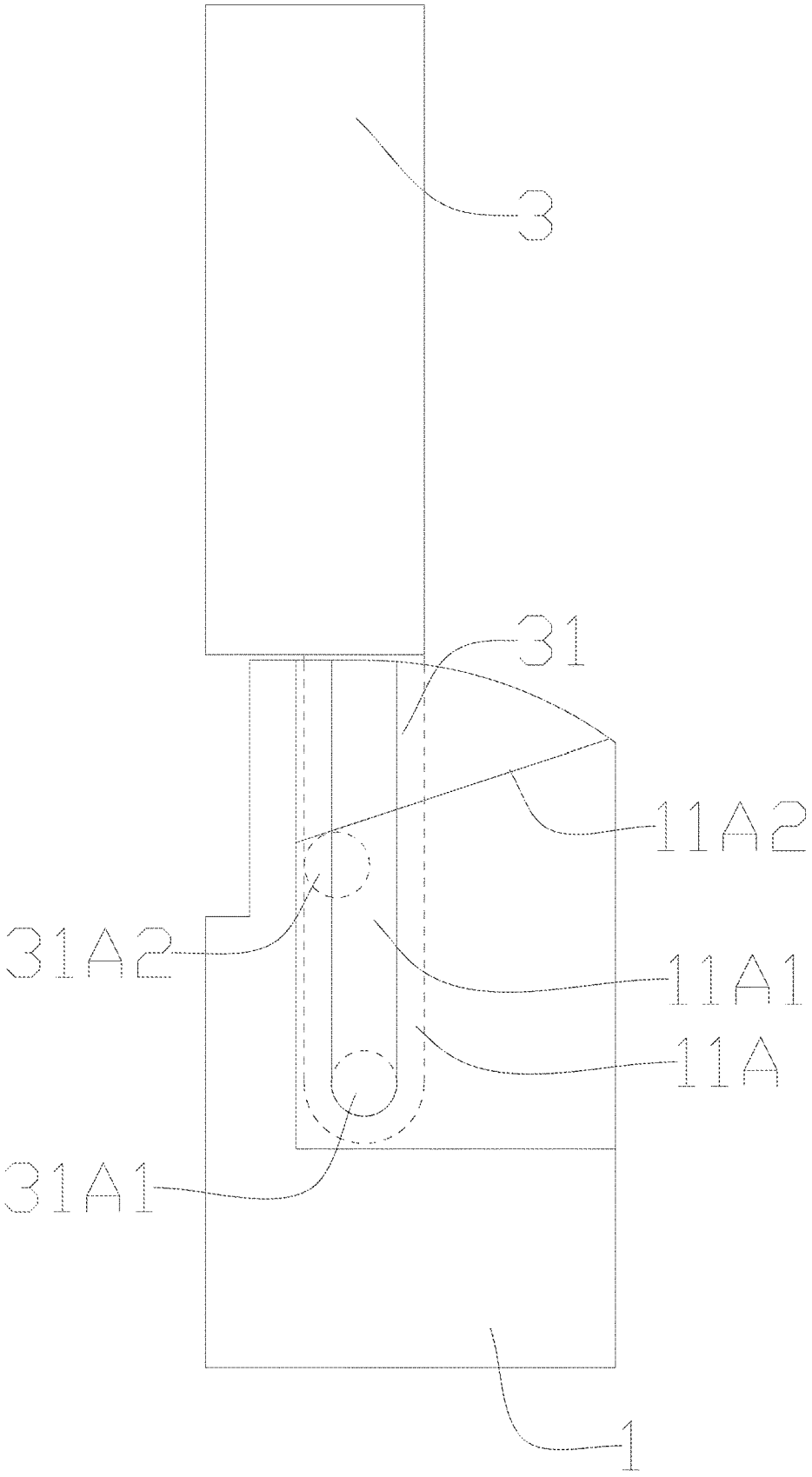

FIGS. 16-17 show a matching view between the hinge protruding portion 31A and the hinge groove 11A. As shown in FIGS. 16-17, when the side plate 3 is changed from the folded state to the open state, the hinge pin 31A1 move downwards in the straight groove 11A1. The outer surface of the guide pin 31A2 remain contacting with the fifth side surface 11A3, and as the center of the side plate 3 rises, the guide pin 31A2 continuously slide downwards along the fifth side surface 11A3. When the side plate 3 is fully opened, the guide pin 31A2 moves to the end of the fifth side surface 11A3, i.e., the joint of the fifth side surface 11A3 and inner wall of the hinge groove 11A.

It should be understood that, in the present embodiment, the thickness of the hinge groove 11A is widened comparing with the first embodiment and the second embodiment, that is, the thickness of the hinge groove 11A in the thickness direction along the side plate 3 is widened.

The fourth embodiment and the fifth embodiment will be described below with reference to FIGS. 18-21. The main difference between the fourth and fifth embodiments and the first, second, and third embodiments lies in that at least one guide portion and a polarity of hinge protruding portion are protruded from the lower side of the side plate. Preferably, two guide portions are protruded from the lower side, and the two guide portions are respectively located at two ends below the side plate. In the following description, only one guide portion would be taken as example for description. But those skilled in the art should understand there may be multiple guide portions or merely only one guide portion below the side plate. And the location of the guide portion below the side plate may be set depending on the actual need. For example, a guide portion is provided in the middle portion below the side plate, and multiple guide portions are equidistantly provided below the side plate. Correspondingly, guide grooves are provided on the corresponding position of the base with the guide portion of the side plate.

The Fourth Embodiment

Figure 18:
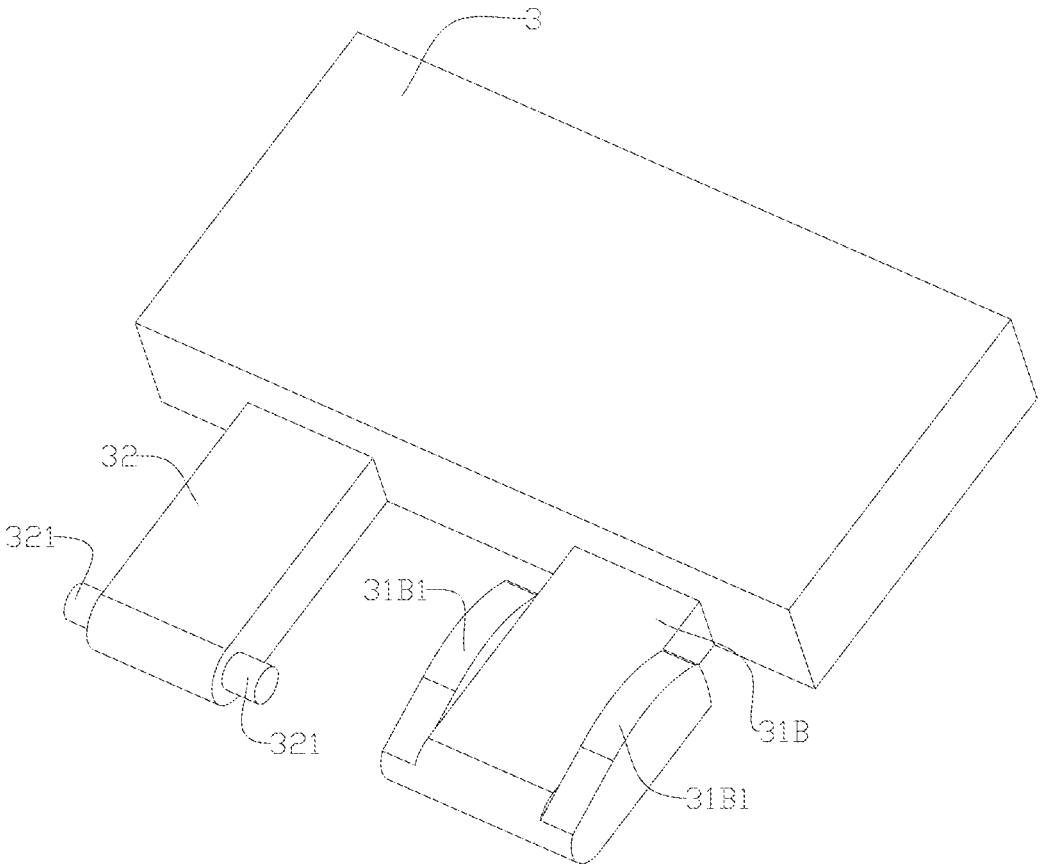
FIG. 18 shows a perspective view of a guide part and a hinge protruding portion according to a fourth embodiment of the present invention.

FIG. 18 schematically shows a guide portion and a hinge protruding portion according to the fourth embodiment of the present invention. As shown in FIG. 18, the main difference between the fourth embodiment and the first embodiment is that a guide portion 31B and a hinge protruding portion 32 are integrally protruded from the lower end of the side plate 3, wherein protruding blocks 31B1 are respectively provided on both sides of the guide portion 31B, and the structure and shape of the protruding block 31B1 is as same as those of the protruding block 312 of the first embodiment, which will be not described in detail in the fourth embodiment. Hinge pins 321 are respectively provided on both sides of the hinge protruding portion 32, and the structure and shape of the hinge pin 321 are as the same as those of the hinge pin 311 described in the first embodiment, which will not be described herein.

Figure 19:
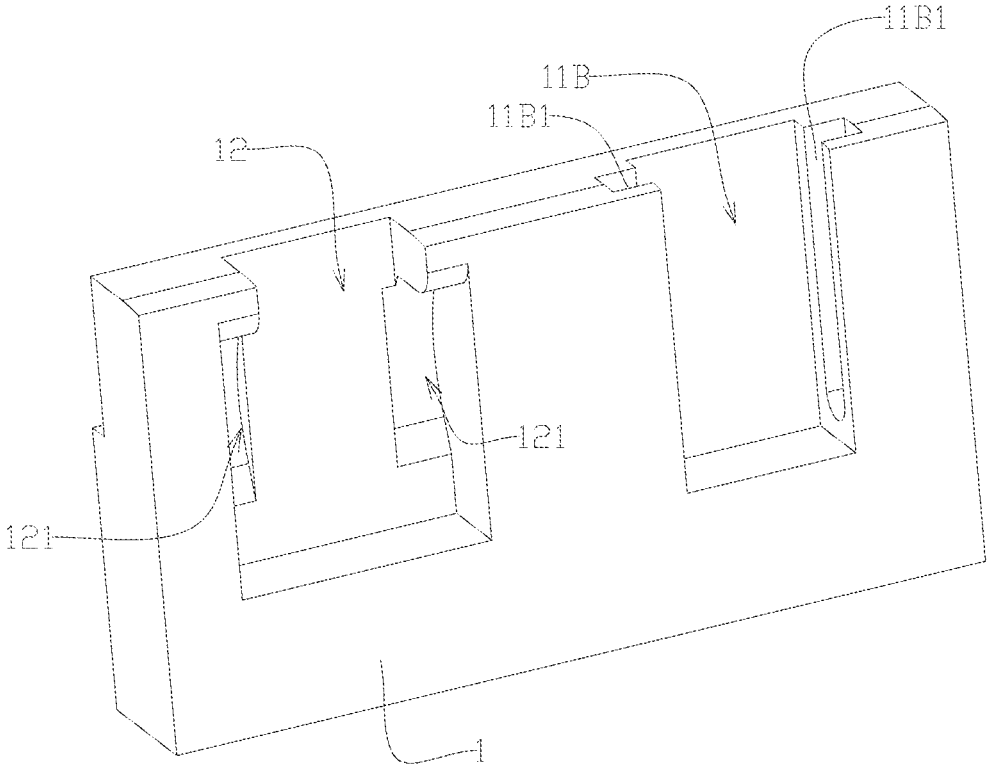
FIG. 19 shows a perspective view of a hinge groove and a guide groove according to the fourth embodiment of the present invention.

FIG. 19 schematically shows a hinge groove and a guide grove according to the fourth embodiment of the present invention. Straight grooves 11B1 are provided on both sides of the hinge groove 11B. The straight grooves 11B1 are used for cooperating with the hinge pin 321. The specific cooperative manner is as same as those of the hinge pin 311 and the straight groove 111 in the first embodiment, which will not described herein.

The side grooves 121 are respectively provided on both sides of the guide groove 12, and the side grooves 121 are used for cooperating with protruding blocks 31B1. The specific structure, shape of the side groove 121 and the cooperative manner between the side groove 121 and protruding block 31B1 refers to that of the side groove 112 and the cooperative manner between side grove 112 and protruding block 312 according to the first embodiment.

The Fifth Embodiment

Figure 20:
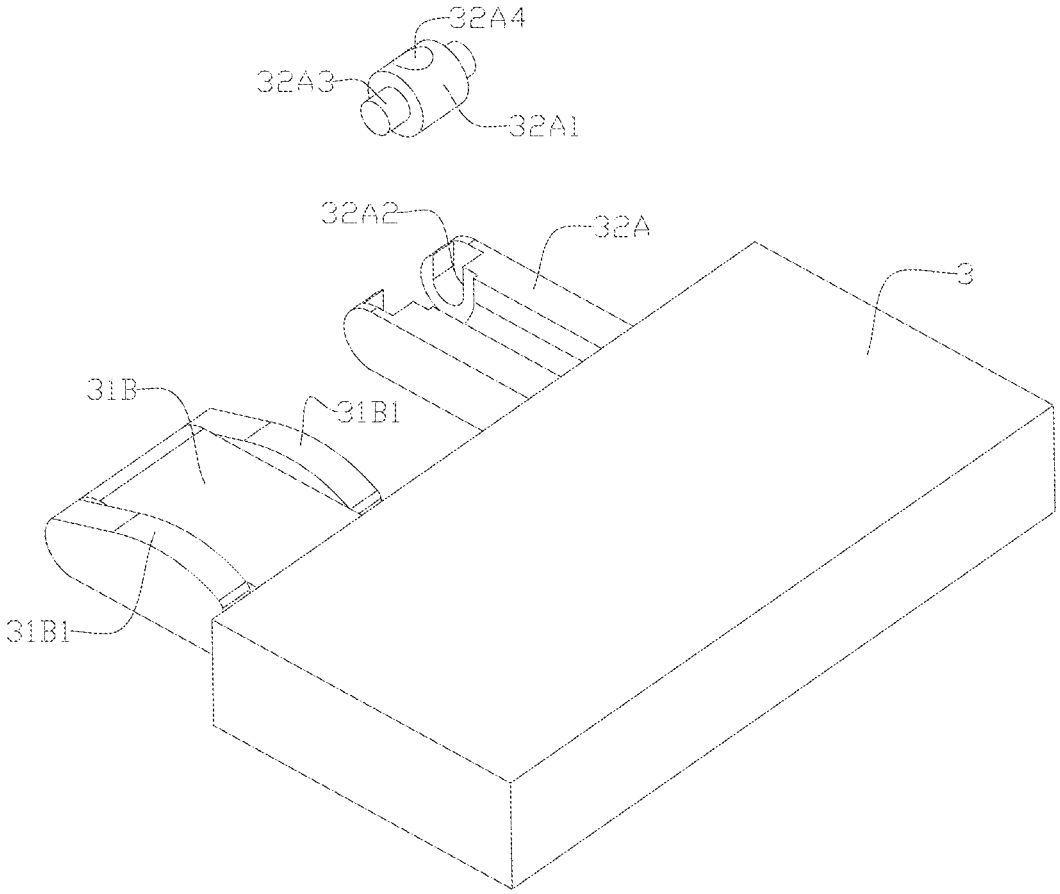
FIG. 20 shows an exploded perspective view of a guide part and a hinge protruding portion according to a fifth embodiment of the present invention.

FIG. 20 schematically shows a guide portion and a hinge protruding portion according to the fifth embodiment of the present invention. As shown in FIG. 20, the main difference between the fifth embodiment and the fourth embodiment lies in the hinge protruding portion. The hinge protruding portion 32A of the embodiment 5 comprises a hinge pin 32A1 and a recess 32A2, and the hinge pin 32A1 is fitted in the recess 32A2 and is rotatable in the recess 32A2. Specifically, protrusions 32A3 are provided on both ends of the hinge pin 32A1. The protrusion 32A3 cooperates with the recess 32A2 and is rotatable in the recess 32A2, and a through hole 32A4 is provided in the middle of the hinge pin 32A1.

Figure 21:
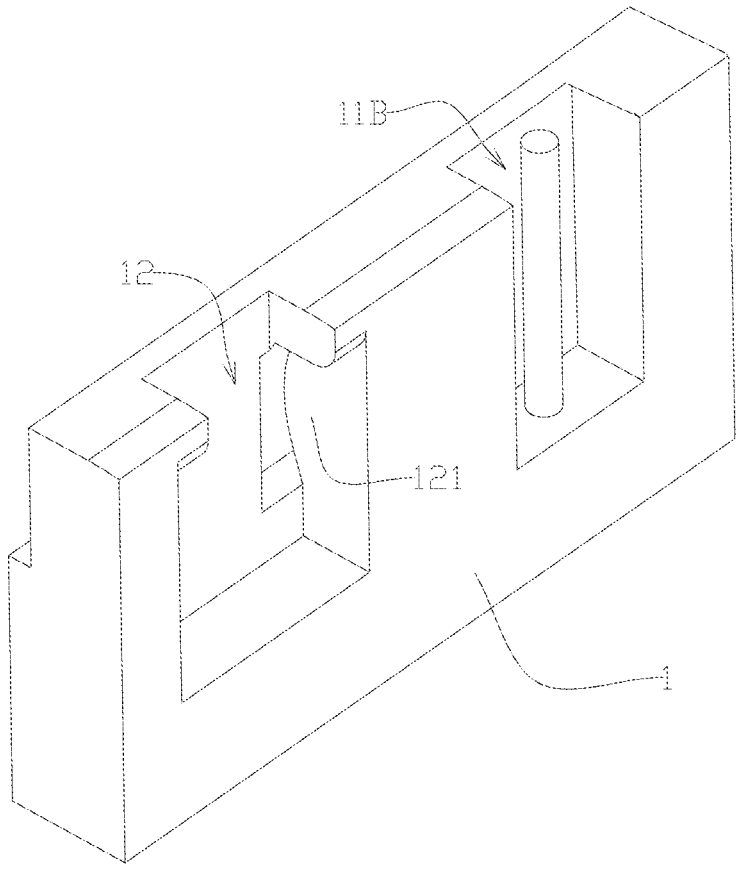
FIG. 21 shows a perspective view of a guide groove and a hinge groove according to the fifth embodiment of the present invention.

FIG. 21 schematically shows a guide groove and a hinge groove according to the fifth embodiment of the present invention. A guide groove 12 and a hinge groove 11B are provided on the corresponding position of the base 1 with the guide portion and the hinge protruding portion. A matching pin 11B1 is provided in the hinge groove 11B, and the matching pin 11B1 is used for cooperating with a through hole 32A4 of the hinge protruding portion 32A, that is, the matching pin 11B1 passes through the through hole 32A4 and is slidable up and down within the through hole 32A4.

The guide portion 31B1 and the guide groove 12 of the present embodiment are as same as those of embodiment 4, which will not be described herein. It should be understood, the guide portion and the guide groove of the present invention are not limited to the form of the fourth embodiment and the fifth embodiment, for example, the form of the guide pin of the third embodiment may also be used as the guide portion of the present invention. That is, the purpose of the present invention can be achieved by providing guide pin on both sides of the guide portion and providing corresponding structure cooperating with the guide pin on the base. Of course, it also may be achieved by providing guide pin or protruding block on either side of the guide portion. When providing a polarity guide portion below one side plate, guide pin or protruding block can merely be provided at the opposite side of the guide portion. These modifications may also achieve the object of the present invention.

The Sixth Embodiment

Figure 22:
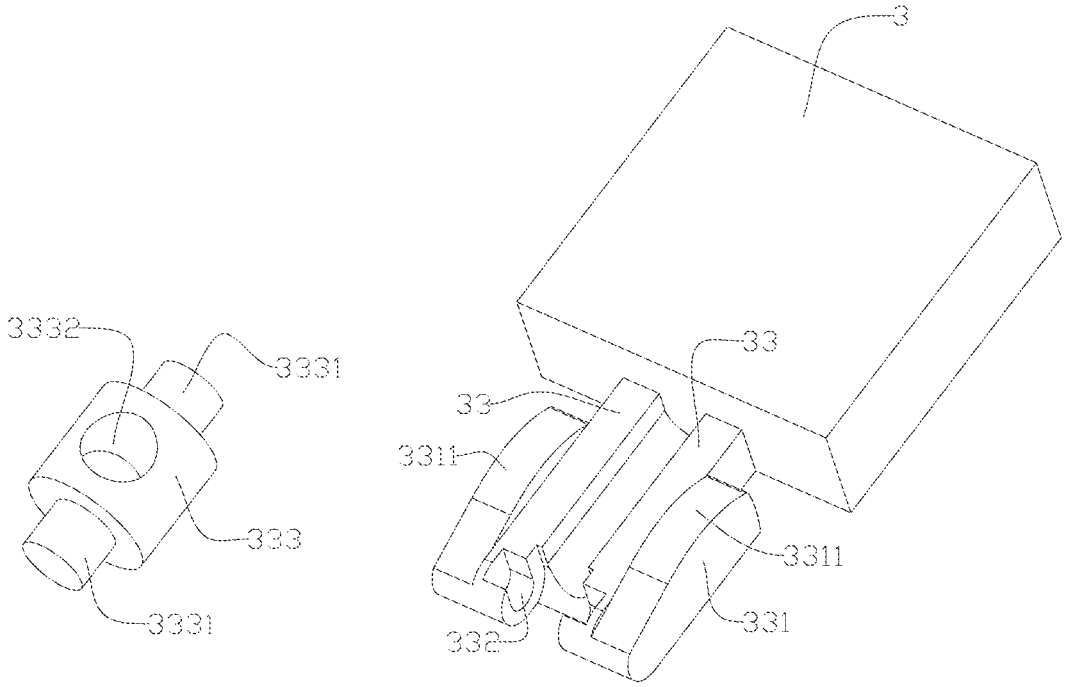
FIG. 22 shows an exploded perspective view of a hinge protruding portion according to a sixth embodiment of the present invention.
Figure 23:
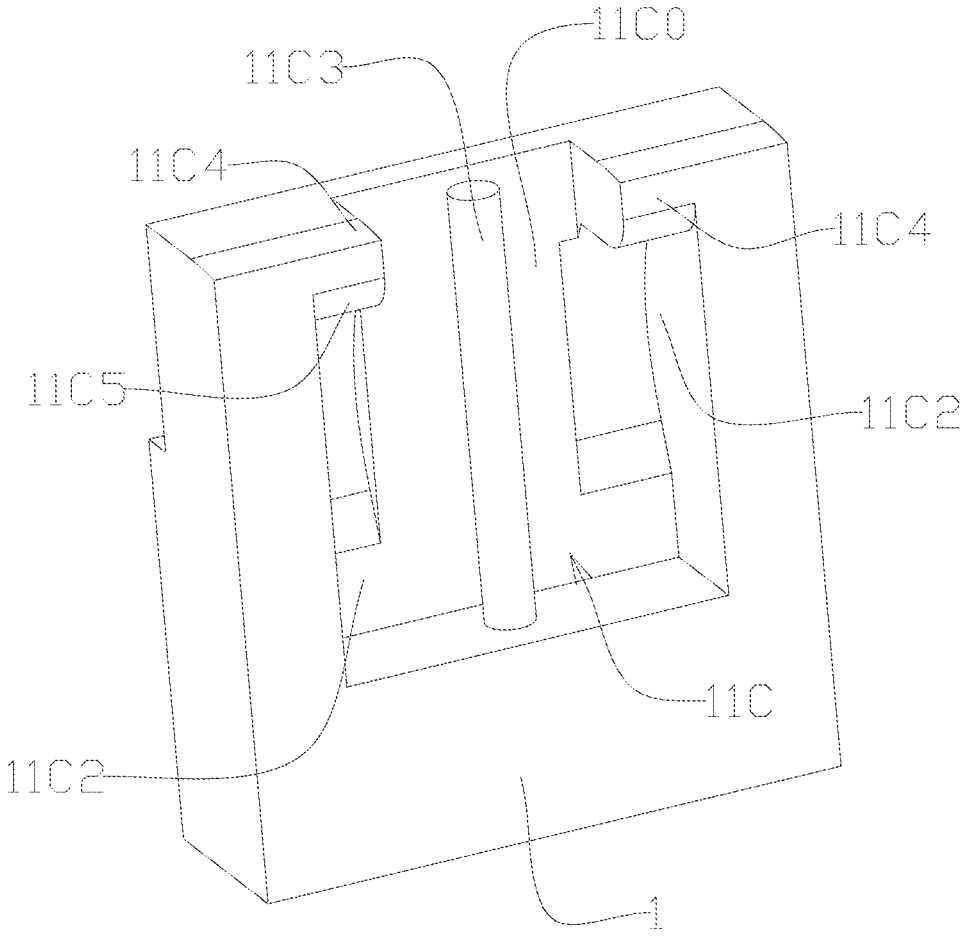
FIG. 23 shows a perspective view of a hinge groove according to the sixth embodiment of the present invention.
Figure 24:
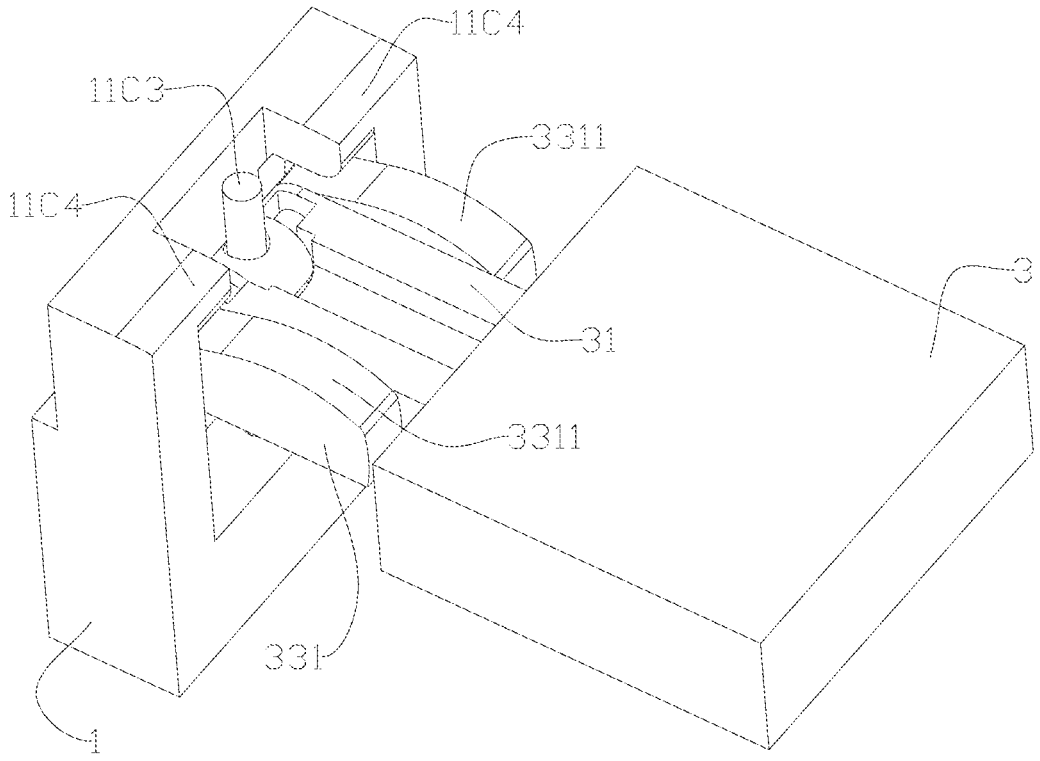
FIG. 24 shows a perspective view of the hinge protruding portion after being fitted to the hinge groove according to the sixth embodiment of the present invention.

The sixth embodiment of the present invention will be described below with reference to FIGS. 22-24. FIG. 22 shows an exploded view of a protruding portion according to the sixth embodiment of the present invention. FIG. 23 shows a groove according to the sixth embodiment of the present invention. FIG. 24 shows the engagement relationship of the protruding portion and the groove according to the sixth embodiment of the present invention.

As shown in FIG. 22, the protruding portion 33 is protruded from the lower end of side plate 3 and comprises a hinge pin 333 and a recess 332. The hinge pin 333 is fitted in the recess 332 and is rotatable within the recess 332. Specifically, protrusions 3331 are respectively provided on both ends of the hinge pin 332. And the protrusion 3331 cooperates with the recess 332, and is rotatable within the recess 332, and the through hole 3332 is provided in the middle of the hinge pin 333.

Protruding blocks 331 are respectively provided on both sides of the protruding portion 33. The specific structure and shape of the protruding block 331 are as same as those of the protruding block 312 of the first embodiment, which will not be described herein.

As shown in FIG. 23, the groove 11 comprises a main groove 11C0, side grooves 11C2 which are respectively provided on both sides of the main groove 11C0, and a matching pin 11C3 located in the main groove 11C0. The main groove 110 is used for accommodating the protruding portion 33. The side groove 11C2 cooperates with the protruding block 331, and a stopper 11C4 is provided above the side groove 11C2. When the protruding block 331 is located in the side groove 11C2, the stopper 11C4 serves to limit the protruding block 331 and restrict the protruding block 331 from moving upwards. The stopper 11C4 is further provided with a second side surface 1105. The matching pin 11C3 is provided in the main groove and protruded in the direction along the side plate 3.

FIG. 24 shows a matching relationship between the protruding portion and groove according to the sixth embodiment of the present invention. As shown in FIG. 24, a matching pin 11C3 passes through the through hole 3332 and can slide up and down in the through hole 3332 after being assembled. When the side plate 3 is changed from the folded state to the open state relative to the base 3, as one side of the side plate 3 is raised, the hinge pin 333 can rotate within groove 332 and slide upwards along the matching pin 11C3. The protruding block 331 cooperates with the side groove 11C2, and the specific cooperating manner refers to that of the protruding block 312 and the side groove 112 according to the first embodiment.

While preferred embodiments of the present invention have been described in detail above, it should be understand that while in the embodiments of the present invention, the protruding block, the side groove, the guide pin and the fifth side surface are respectively provided in hinge protruding portion of the side plate 3 and the hinge groove of the base 1, but the protruding block, the side groove, the guide pin and the fifth side surface may also be provided in other structures of the side plate and the base, respectively, that is, the protruding block, the side groove, the guide pin and the fifth side are not limited to applicable to the foldable container in which the side panel and the base are connected by the hinge structure. As long as it is a foldable container in which the side panel and the base can be folded disorderly, and as long as there exists such a situation that some structures (such as the buckle of the side plate relative to the base) on the side plate may interfere with the base and thereby the side plate and the base may be damaged when folding the side plate, the protruding block and the side slot and the guide pin of the invention can be provided. In addition, the continuous curved surface profile of the present invention is not limited to the form of the first side surface provided on the protruding block and the fifth side surface provided under the stopper.

While the preferred embodiments of the present invention have been described in detail, it should be understand that various modifications or changes may be made to the present invention by those skilled in the art after reading the above teachings of the present invention. These equivalent forms also fall within the scope of the appended claims of the present application.

What is claimed is:

1. A foldable container, comprising:

a base; and two pairs of side plates connected to the base via a hinge structure, wherein a plurality of protruding portions are provided on the side plates and a plurality of grooves are provided on the base to match the protruding portions, wherein the hinge structure is provided in at least one of the protruding portions and in at least one of the grooves, wherein the at least one protruding portion of the protruding portions is further provided with a non-circular continuous curved surface profile with a curvature change, and the at least one of the grooves is further provided with at least one matching surface to match the continuous curved surface profile, wherein during the process that the side plates are changed from a folded state to an open state, the continuous curved surface profile remains in contact with the matching surface, thereby preventing interference between the side plate and the base when the side plate is turned over, and wherein the continuous curved surface profile is tangential to the matching surface when the side plates are changed from the folded state to the open state, and the base generates a result force on the side plates, and the result force is decomposable into a vertical component force causing the protruding portions to move downward and a horizontal component force parallel to the base.

2. The foldable container of claim 1, wherein at least one side of the protruding portions provided with the continuous curved surface profile is provided with a protruding block, and the continuous curved surface profile is a first side surface provided on the protruding block, and a corresponding side of the grooves provided with the matching surface is provided with a side groove, and a stopper is provided above the side groove, and the matching surface is a second side surface provided on the lower side of the stopper.

3. The foldable container of claim 2, wherein the continuous curved surface profile further comprises a third side surface, which is configured to contact and match the lower side of the stopper when the side plates are upright with respect to the base.

4. The foldable container of claim 2, wherein the continuous curved surface profile further comprises a third side surface, and there is a predetermined gap between the third side surface and a lower side surface of the side plates.

5. The foldable container of claim 2, wherein the first side surface and the second side surface are configured when the side plates are changed from the folded state to the open state, the first side surface inscribe and contact with the second surface and the base generates the result force on the side plates.

6. The foldable container of claim 5, wherein an angle between the result force and the horizontal force is less than or equals to 45 degrees.

7. The foldable container of claim 1, wherein the hinge structure comprises a hinge pin provided on the protruding portions and a matching structure provided in the at least one of the grooves.

8. The foldable container of claim 7, wherein one side of the protruding portions is provided with the hinge pin and the other side of the protruding portions is provided with the continuous curved surface profile, and the matching structure is a straight groove provided on one side of the at least one of the grooves.

9. The foldable container of claim 7, wherein the continuous curved surface profile is provided on two sides of the protruding portions, and the hinge pin is provided on a front end of the protruding portions, wherein the matching structure is configured to match the hinge pin so that the hinge pin is movable up and down along the matching structure.

* * * * *